US005867948A

United States Patent [19]

Liu

[11] Patent Number: 5,867,948

[45] Date of Patent: Feb. 9, 1999

[54] ARCHED FRAMEWORK AND ITS ASSEMBLY METHOD

[76] Inventor: Zhiwei Liu, No. 29, Bldg. 59, P.O. Box 32, Jilin City, Jilin 132102, China

[21] Appl. No.: 666,355

[22] PCT Filed: Dec. 23, 1994

[86] PCT No.: PCT/CN94/00104

§ 371 Date: Aug. 22, 1996

§ 102(e) Date: Aug. 22, 1996

[87] PCT Pub. No.: WO95/17559

PCT Pub. Date: Jun. 29, 1995

[30] Foreign Application Priority Data

Dec. 23, 1993 [CN] China ..... 93 1 20116.0

[51] Int. Cl.[6] ..... E04B 1/32

[52] U.S. Cl. ..... 52/80.1; 52/80.2; 52/80.3; 52/86; 52/88; 52/656.9; 52/690; 52/692

[58] Field of Search ..... 52/80.1, 80.2, 52/80.3, 86, 88, 690, 692, 656.9

[56] References Cited

U.S. PATENT DOCUMENTS

| | | | |
|---|---|---|---|
| 2,278,797 | 4/1942 | Raymond | 52/86 X |
| 2,351,419 | 6/1944 | Fuller . | |
| 3,424,178 | 1/1969 | Yazaki . | |
| 3,488,901 | 1/1970 | Peterschmidt | 52/81.3 |
| 3,798,851 | 3/1974 | Utahara . | |
| 3,889,433 | 6/1975 | Eubank, Jr. . | |
| 4,115,975 | 9/1978 | Bliss . | |
| 4,325,207 | 4/1982 | Russell et al. | 52/86 X |
| 4,650,361 | 3/1987 | Seuster | 52/81.3 X |
| 5,051,019 | 9/1991 | Kohl | 52/81.3 X |
| 5,444,946 | 8/1995 | Zeigler | 52/81.3 X |
| 5,595,203 | 1/1997 | Espinosa | 52/86 X |

FOREIGN PATENT DOCUMENTS

| | | |
|---|---|---|
| 2280749 | 2/1976 | France . |
| 766314 | 1/1957 | United Kingdom . |

*Primary Examiner*—Christopher Kent
*Attorney, Agent, or Firm*—Birch, Stewart, Kolasch & Birch, LLP

[57] ABSTRACT

A structure frame made of arches is formed with a plurality of curved frame units in parallel arrangement, where the curved frame units having butt joints (6) are connected in length by several straight bars (16) and the butt joints (6). The straight bars are connected in line at right angles with the curved frame units in order to form a truss. The curved frame units include curved bars (14) and tie members (11) where the curved bars are connected to form the curved frame units by the tie members (11) and the butt joints (6). A tension member (9) is provided between the curved frame units and the trusses.

18 Claims, 11 Drawing Sheets

B - B

A - A

D – D

ARCHED FRAMEWORK AND ITS ASSEMBLY METHOD

FIELD OF THE INVENTION

This invention relates to an architechtural structure, more particularly, to a curved-surface net-like arched framework formed by inserting and hooking engagements.

BACKGROUND OF THE INVENTION

For constructing large-spanned and widely-covered buildings such as stadiums and gymnasiums, spatial lattice-framed structures have mostly been used, within existing techniques which require at least one of the following: more complicated design and construction; higher accuracy of manufacture for structural members; more consumption of raw materials; longer project time limit; higher cost of construction; and the necessity of employing scaffolds and large-scale sling equipment while under construction. In addition, the buildings made by those techniques can only be positioned permanently at one place, cannot be disassembled and then moved as desired. Furthermore, such techniques have narrow range of application, such as for houses and buildings.

SUMMARY OF THE INVENTION

An object of the present invention is to provide an arched framework widely applicable to various architectureal fields and capable of rapid assembling and disassembling. The assembling and disassembling can be achieved by insertion and extraction, hooking and unhooking of structural members. For the members which form the framework, there will be less varieties, unified standards, simple configurations and easy technologies, and they can be produced mechanizedly and repeatedly in large-scale production. The present framework, with a definite engagement fashion, can be used to construct different kinds of both permanent buildings and mountable buildings. There is no need during its construction for scaffolds and large-scale sling equipment.

Another object of the present invention is to provide a method for assembling the arched framework without any high-altitude operation.

The objects of the present invention can be achieved in the way where the structural members include curved bars, straight bars, tie rods, chord members, double curved bar units, rectangular-shaped bullet connectors, cross-like universal bullet connectors, semicircular multi-head bullet connectors and cross-like, T-shaped and right-angled bullet connectors which generally are referred to as bullet connectors. By utilizing straight bars; tie rods or chord member as commonly-used members; providing curved bars or double curved bar units; selecting corresponding bullet connections; and by means of inserting and hooking engagements, an arched framework of curved-surface net-like single-tier type, double-tier type and single- and double-tier hybrid type, as well as spheric net-like single-tier type can be made. Either a single-tier type or double-tier type or single-and double-tier hybrid type arched framework can be the main body of a building, and a spheric single-tier type arched framework can be the end closure for main body structure. There is also an elevational gable wall type of end closures. The main body and end closures are connected to each other by attachments.

Each structural member of a single-tier arched framework includes a plurality of curved bars, straight bars, tie rods and chord members and cross-like, T-shaped and right-angled bullet connecters which generally are referred to as bullet connectors. In the framework each, bullet connector is insertingly engaged with straight bars and curved bars, and hookingly engaged with tie rods and chord members. A plurality of curved bars are insertingly engaged along a curve, through a plurality of bullet connectors, to form an arc-shaped frame. A plurality of chord members are used, through the bullet connectors, to connect the arc-shaped frame formed by insertingly engaged curved bars into a unit. A plurality of arc-shaped frames, parallel to each other and having the same projective plane, are longitudinally connected together, through the bullet connectors, by a plurality of straight bars.

All of the straight bars connected along straight lines form trusses. The trusses are parallel to each other and orthogonally connect to all arc-shaped frames. Arch-shaped frames with arc-shaped frames, arc-shaped frames with trusses, and trusses with trusses are connected through a plurality of tie rods to form a curved-surface net-like integral. The integral arched framework is composed of a plurality of elements with quadrangular lattices. Each quadrangular element includes four bullet connectors, two straight bars and two curved bars. Four bullet connectors provide four corners of quadrangle. The curved bars and straight bars are orthogonally insertingly engaged into the bullet connectors to form adjacent sides. Along each of the two diagonals of a quadrangular element there is disposed a tie rod. Each end of the tie rod is hookingly engaged with a bullet connector. Along each chord defined by the farthest spaced ends of two curved bars of each pair of quadrangular elements connected transversely, there is disposed a chord member. Each end of the chord member is hookingly engaged with a bullet member. Two curved bars and one chord member form a bow-like frame. These are a plurality of bow-like frames in an arc-shaped frame. Each bullet connector of an arc-shaped frame is hookingly engaged with two chord members. Two adjacent chord members are crossed relative to each other. The crossed chord members make equal the forces on each curved bar of an arc-shaped frame. A plurality of quadrangular elements are transversely sequentially expanded to form a small portion of an arched framework with a certain span. According to the length required, a plurality of quadrangular elements are sequentially expanded along the longitudinal direction of an arc-shaped frame to thus form an integral arched framework with a certain length and span.

In the arched framework, an intersection of the central lines of all four quadrangular elements, which are connected with each other is formed by a cross-like bullet connector. At the edges of the integral structure, an intersection of two quadrangular elements is formed by a T-shaped bullet connector. At the four corners of the integral structure, a corner of one quadrangular element is formed by a right-angled bullet connector. Each arc-shaped frame in the arched framework is perpendicularly connected to trusses while each truss is also perpendicularly connected to arc-shaped frames.

The structural members of another single-tier arched framework are each composed of a plurality of curved bars, straight bars, tie rods, chord members, T-shaped bullet connectors, right-angled bullet connectors, cross-like universal bullet connectors and semicircular multi-head bullet connectors. In a structure member, each bullet connector is insertingly engaged with straight bars and curved bars and hookingly engaged with tie rods and chord members. A semicircular multi-head bullet connector is only insertingly engaged with curved bars. A plurality of curved bars are insertingly engaged along a curve, through plurality of cross-like universal bullet connectors to form an arc-shaped frame. A plurality of chord members are used through hooking engagements with a plurality of bullet connectors to connect the arc-shaped frame, which is formed by insertingly engaging with curved bars into an unit. There are a plurality of arc-shaped frames.

The upper ends of the arc-shaped frames are converged into a semicircular multi-head bullet connector located at the shed roof. Straight bars are connected with arc-shaped frames through the cross-like universal bullet connectors on the arc-shaped frames. Straight bars are linearly connected with straight bars in a horizontal direction to form trusses. There are a plurality of trusses, where each is a polygonal line shape. A plurality of tie rods can join, through a certain number of bullet connectors, arc-shaped frames with arc-shaped frames, arc-shaped frames with trusses, and trusses with trusses into an approxamite integral quarter-spheric net structure.

The integral spheric net structure is formed by a plurality of quadrangular elements and triangular elements which form lattices. There is only one row of triangular elements, and it is disposed between the semicircular multi-head bullet connector and an adjacent row of quadrangular elements. A triangular element includes one straight bar, two curved bars, two bullet connectors, two spigots of the semicircular multihead connector, two chord members, and two tie rods. Each quadrangular element includes four bullet connectors, two curved bars and two straight bars. The four bullet connectors form the four corners of a quadrangle. The curved bars and straight bars are orthogonally insertingly engaged into the bullet connectors to form adjacent sides. Along each of the two diagonals of a quadrangular element there is disposed a tie rod, where each end of the tie rod is hookingly engaged with a bullet connector. Along each chord defined by the farthest spaced ends of two curved bars of each pair of transversely adjacent quadrangle elements, a chord member is disposed. Each end of the chord member being hookingly engaged with a bullet connector. Two curved bars and one chord member form a bow-like frame. An arc-shaped frame is composed of a plurality of bow-like frames. Each two adjacent chord members in an arc-shaped frame are crossed relative to each other.

In a structure which is a curved-surface latticed double-tier arched framework, assembled by inserting and hooking engagements with a plurality of straight bars, tie rods and chord members as commonly-used members and a plurality of additional rectangular-shaped bullet connectors and double curved bar units, into each rectangular-shaped bullet connector there are insertingly engaged double curved bar units and straight bars and hookingly engaged tie rods and chord members. Through inserting engagements of a plurality of double curved bar units with a certain number of rectangular-shaped bullet connectors, a double-ridge double-tier arc-shaped frame of rectangular cross-section is formed.

Through rectangular-shaped bullet connectors, a plurality of chord members are used to connect the double-tier arc-shaped frames formed by insertingly engaging with double curved bar units into an integral structure. A plurality of double-tier arc-shaped frames parallel to each other and having the same projective plane are longitudinally connected together through rectangular-shaped bullet connectors and by a plurality of straight bars grouped two by two. The straight bars are linearly connected together in groups to form a double-ply truss. A plurality of double-ply trusses, parallel to each other are orthogonally connected with a plurality of arc-shaped frames. A plurality of tie rods are used to join-through rectangular-shaped bullet connectors double-tier arc-shaped frames with double-tier arc-shaped frames, double-tier arc-shaped frames with double-ply trusses, and double-ply trusses with double-ply trusses, where the structures form an integral curved-surface net.

The integral curved surface is also formed by a plurality of hexagonal elements which form lattices. Each hexagonal element includes four rectangular-shaped bullet connectors, four pieces of double curved bar units and four straight bars. Two rectangular-shaped bullet connectors are insertingly engaged with two pieces of double curved bar units to form a length of curved column of rectangular cross-section. Two groups of straight bars having two in each group are orthogonally insertingly engaged into the rectangular-shaped bullet connector of each end of two curved columns. Together with two pieces of double curved bar units, the straight bars form two rectangular frames having upper and lower curved-surfaces parallel to each other. Along two groups of diagonals of each rectangular frame tie rods are disposed.

The similar ends of the tie rods in two rectangular frames are hookingly engaged with the same rectangular-shaped bullet connector. Along each of the two, upper and lower, chords between the farthest ends in the direction of the extension of double curved bar units of each two transversely adjacent hexagons at least one chord member is disposed. The similar ends of the upper and lower chord members are each hookingly engaged with the same rectangular-shaped bullet connector. Two curved columns are connected with the upper and lower chord members to form a double-tier bow-like frame. A double-tier arc-shaped frame is composed of a predetermined number of double-tier bow-like frames. Each two adjacent chord members in an arc-shaped frame are crossed to each other. In a double-tier arched frame work, the central junction of four hexagons, which are connected together, is formed by a rectangular-shaped bullet connector and the bullet connector is an integral part of each of the four hexagonals respectively.

In the arched framework, on the bullet connectors there are straight bar spigots, curved bar spigots, tie rod connecting lugs and chord member connecting lugs. The straight bar spigots are straight, and the curved bar spigots are curved. At each cut angle formed by the intersection of a straight bar spigot and a curved bar spigot, a tie rod connecting lug is disposed. There are four tie rod connecting lugs on a cross-like bullet connector, and there are two tie rod connecting lugs on a T-shaped bullet connector. There is one tie rod connecting lug on a right angled bullet connector. On each bullet connector there is disposed one chord member connecting lug. On the chord member connecting lug there are locations for two chord members to connect to, where each chord member connecting lug can be hooking engaged with two chord members at the same time.

In the present arched framework, straight bars and curved bars can be connected with bullet connectors by inserting engagements, and straight bars and curved bars can be mutual mating pairs with bullet connectors.

A semicircular multi-head bullet connector is composed of a semicircular disk, a plurality of curved bar spigots, a plurality of chord member connecting lugs and a plurality of tie rod connecting lugs. A plurality of curved bar spigots having the same downward bending angle are uniformly distributed along the curved perimeter of the semicircular disk. At each cut angle formed by curved bar spigots and the semicircular disk there is disposed a tie rod connecting lug. Under the bend axis of each curved bar spigot there is a chord member connecting lug.

On a cross-like universal bullet connector there are two opposite curved bar spigots and two opposite ball-head swivelling spigots. At each cut angle formed by the intersection of the swivelling spigots and the curved bar spigots there is disposed a tie rod connecting lug. A chord member connecting lug is disposed on the cross-like universal bullet connector. Locations exist on the chord member connecting lug for two chord member to connect to.

A rectangular-shaped bullet connector is composed of four bars, a, b, c and d, forming a plane rectangle. At each end of parallel bars a and c, there is a straight bar spigot coaxial with the bars. Two straight bar spigots on the same bar are in opposite directions. On each outer side of bars a and c there are two connecting members perpendicular to the rectangular plane, each connecting member being composed of two curved bar spigots in opposite directions. To make double curved bar units and rectangular-shaped bullet connectors, the two connecting members on each bar are equally spaced. On the same side of bars a and c there is at least one chord member connecting lug. On each chord member connecting lug there locations for two chord members to connect. A chord member connecting lug can be hooking engaged with two chord members in different directions at the same time. At each cut angle formed orthogonally by each straight bar spigot and each curved bar spigot there is a tie rod connecting lug.

A double curved bar unit is composed of two curved bars having the same center but different bend radii and a plurality of connecting bars. The double curved bar unit is planar, and at each end there are two sockets. The sockets of straight bars and double curved bar units are insertingly engaged with the spigots of rectangular-shaped bullet connectors to become mutual mating pairs, and the distance between the centers of two sockets at an end of a double curved bar unit is equal to that the two connecting members of a rectangular-shaped bullet connector.

The single tier arched framework and the double-tier arched framework of the present invention have two assembling methods. One assembling method for a single-tier arched frame is: first, two curved bars are insertingly engaged onto a cross-like bullet connector to form a bow-like frame. Then a plurality of straight bars are used to longitudinally connect a plurality of bow-like frames, forming two rows of shed roof portions having a plurality of quadrangular elements and with the longitudinal length of an arched framework. One lateral part of the shed roof is lifted by a jacking device to reach a level until it is possible for curved bars to be insertingly engaged. Then into each bow-like frame curved bars are insertingly engaged through bullet connectors and all insertingly engaged curved bars are again connected through straight bars to form a longitudinal row of quadrangular elements.

While forming the quadrangular elements, tie rods and chord members are hookingly engaged. At this time, one lateral side is lowered and the other lifted. Again, curved bars, straight bars and cross-like bullet connectors are connected in the above manner to further form a row-of quadrangular elements. By repeatedly operating at both laterals of the shed roof in this way, the main body of a single-tier arched framework can be gradually erected from the shed roof end to the two grounding ends of the arched framework.

The other assembling method for a single-tier arched framework is first, two right-angled bullet connectors and a plurality of T-shaped bullet connectors are used to connect a plurality of strengthening straight bars into a lateral grounding end along the longitudinal length of the arched framework. Then into the above-described bullet connectors there are insertingly engaged curved bars, and a certain number of straight bars to connect all curved bars through a plurality of cross-like bullet connectors, forming a row of connected quadrangular elements with the longitudinal length of the arched framework. While forming the quadrangular elements, tie rods and chord members are hookingly engaged. Then the straight bar which is lateral of quadrangular elements is lifted by a jacking device to reach a level until it is possible for curved bars to be insertingly engaged.

Again, by insertingly engaging curved bars and longitudinally connecting the curved bars by a plurality of straight bars through cross-like bullet connectors, a row of quadrangular elements is once again formed. And the newly formed quadrangular elements are lifted again by a jacking device until it is possible for curved bars to be insertingly engaged. A row of quadrangular elements is formed again through the inserting engagements of cross-like bullet connectors with curved bars. By repeatedly operating in this way to sequentially expand quadrangular elements transversely, the main body of a single-tier arched framework can be gradually erected from one lateral grounding end of the arched framework, through the shed roof, to the other lateral grounding end.

One assembling method of a double-tier arched framework is first, three rectangular-shaped bullet connectors are used to form a double-tier bow-like frame through four double curved bar units. Straight bars having two in each group are used to connect longitudinally a plurality of double-tier bow-like frames, forming two rows of shed roof portions having the longitudinal length of the arched framework formed by a certain number of hexagonal elements. One lateral part of the shed roof is lifted by a jacking device. When a level is reached where it is possible for double curved bars to be insertingly engaged, into each double-tier bow-like frame curved bars are insertingly engaged through rectangular-shaped bullet connectors, and into the other ends of these curved bars rectangular-shaped bullet connectors are also insertingly engaged.

These rectangular-shaped bullet connectors are connected by a predetermined number of groups of straight bars to form a longitudinal row of hexagonal elements. While forming the hexagonal elements, tie rods and chord members are hookingly engaged. At this time, one lateral is lowered and the other lifted, and double curved bar units, straight bars and rectangular-shaped bullet connectors are again connected in the above manner to further form a row of hexagonal elements. By repeatedly operating in this way at both laterals of the shed roof, the main body of a double-tier arched framework can be gradually erected from the shed roof end to the two grounding ends of the double-tier arched framework.

The other assembling method for a double-tier arched framework is first, a plurality of rectangular-shaped bullet connectors are used to connect a plurality of strengthening straight bars into a lateral grounding end along the longitudinal length of the arched framework. Then a plurality of straight bars having two in each group are used to connect all of the curved bars through above rectangular-shaped bullet connectors, forming a row of connected hexagonal elements along the longitudinal length. While forming the hexagonal elements, tie rods and chord members are hookingly engaged. After that, the edge corresponding to the straight bars in the hexagonal elements is lifted by a jacking device to reach the level until it is possible for double curved bar units to be insertingly engaged. Again, by insertingly engaging double curved bar units and connecting longitudinally all the double curved bar units by a plurality of groups of straight bars through rectangular-shaped bullet connectors, a row of hexagonal elements is once again formed.

And the nearly formed hexagonal elements are lifted again by a jacking device until it is possible for the double curved bar units to be insertingly engaged, thus a row of hexagonal elements is formed again through the inserting engagements of rectangular-shaped bullet connectors with double curved bar units. By repeatedly operating in this way to sequentially expand hexagonal elements transversely, the main body of a double-tier erected framework can be gradually arched from one lateral grounding end of the arched framework, through the shed roof, to the other lateral grounding end.

The present invention is a simple configuration; easy to disassemble with common and exchangeable components; it has reduced building materials in construction, and has easily manufactured components. After the arched framework is disassembled and removed as required, components can be repeatedly used, thus reducing the project cost of construction. An architectural structure of a tennis gym with an arched framework of the area of 1300 square meters can be constructed by 20 workers in 5 days without using scaffolds and large-scale sling equipment. By adopting crossed chord members and crossed tie rods in the structure, the effective space and loading capacity of the framework is substantially increased. The present arched framework is completed under new ideas of design, shocking the traditional architectural design by creating a new form of no high-altitude operation in architecture field.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE DRAWINGS

The present invention will become more fully understood from the detailed description given hereinbelow and the accompanying drawings which are given by way of illustration only, and thus are not limitative of the present invention and wherein.

PREFERENTIAL EMBODIMENTS OF THE INVENTION

Figure 1:
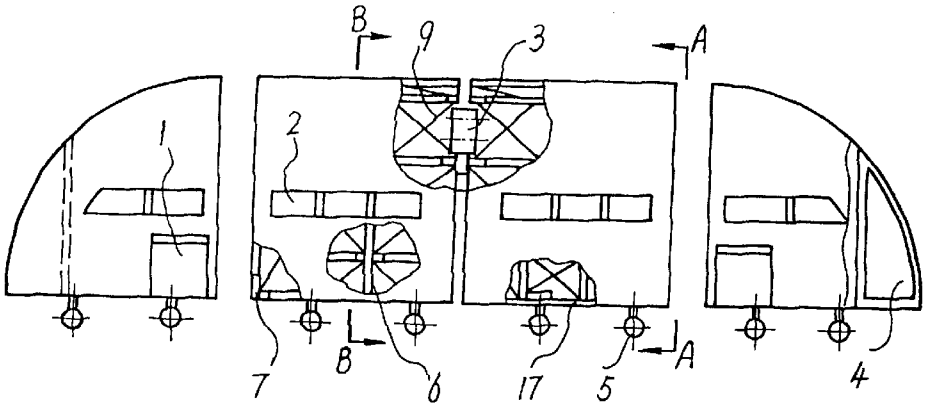
FIG. 1 is a schematic elevational view of an aircraft shed of the present arched framework.
Figure 2:
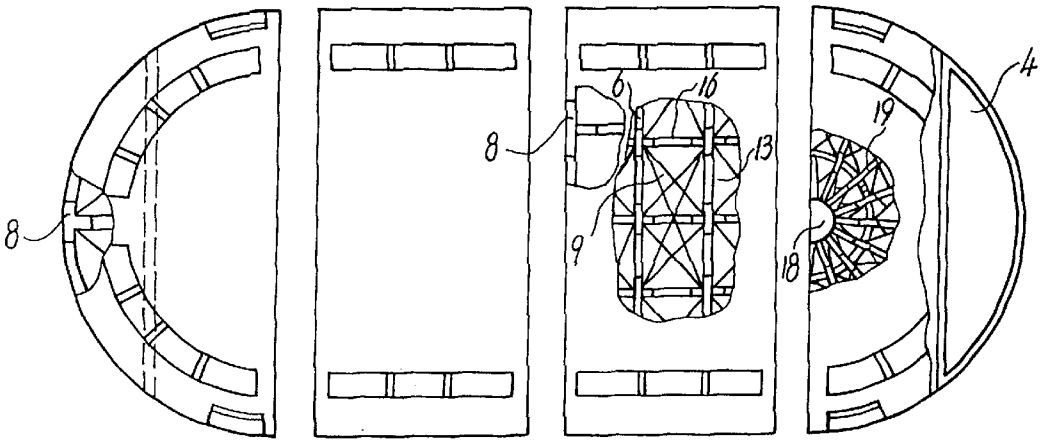
FIG. 2 is a schematic top view of the aircraft shed.
Figure 3:
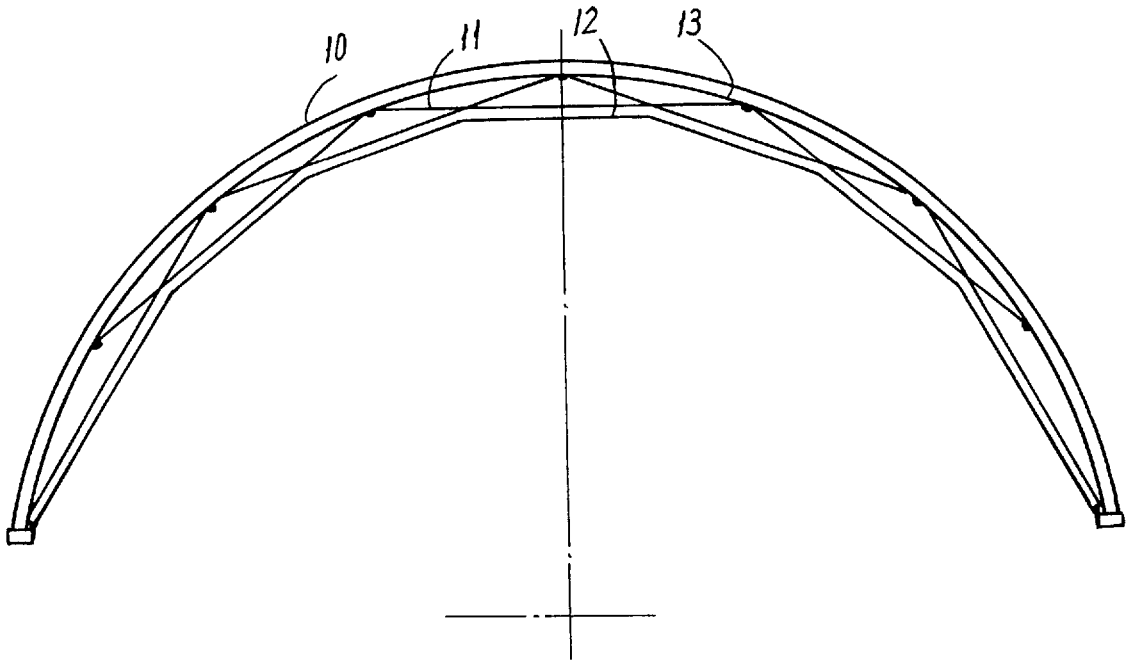
FIG. 3 is a schematic sectional view of the single-tier arch framework, taken along B—B line of the aircraft shed.
Figure 4:
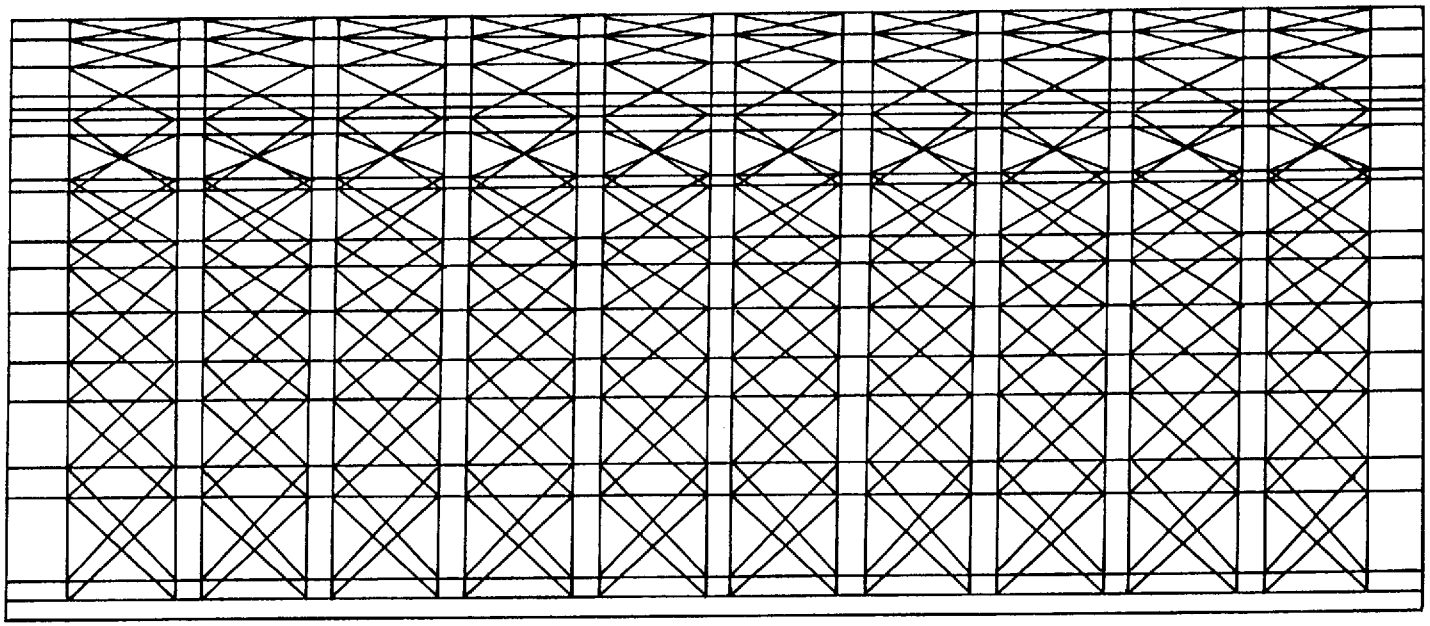
FIG. 4 is, a schematic elevational view of a double-tier arched framework.
Figure 5:
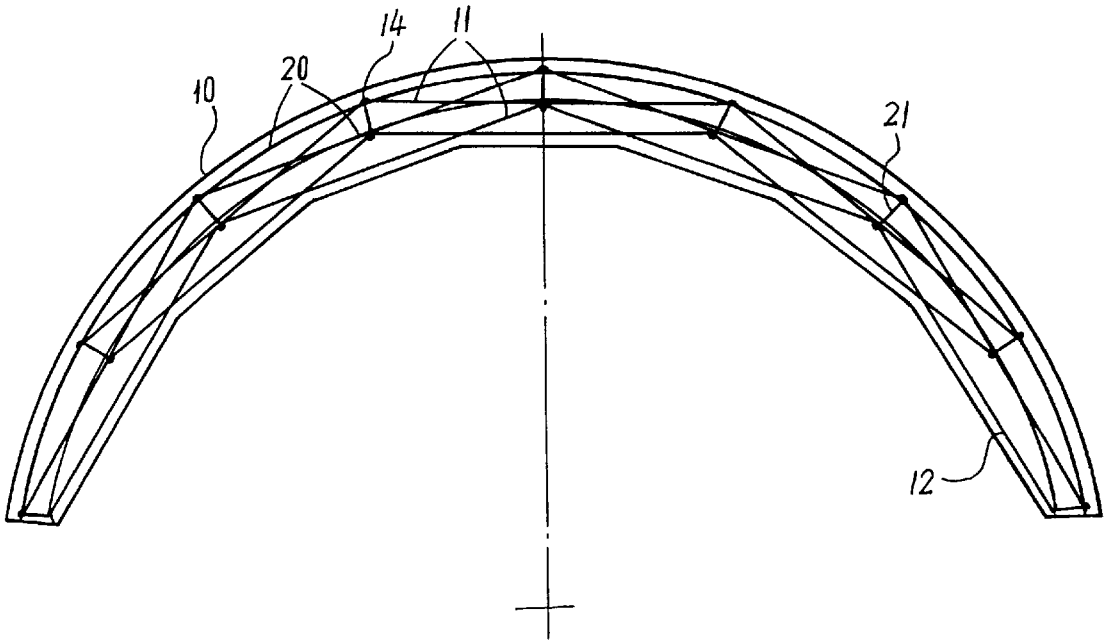
FIG. 5 is a schematic sectional view of the double-tier arched framework, taken along A—A line.
Figure 7:
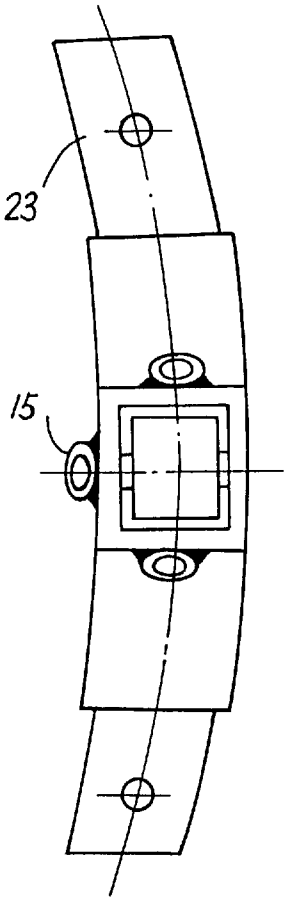
FIG. 7 is a side view of cross-like bullet connector.
Figure 6:
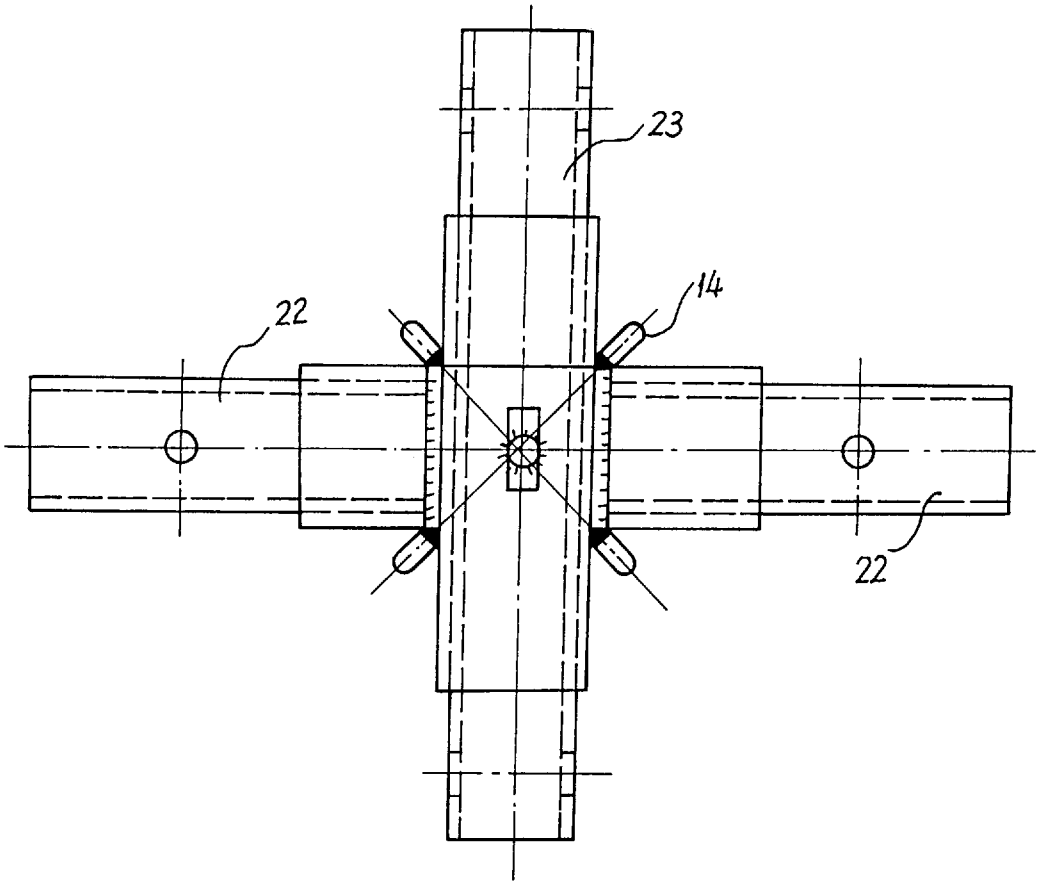
FIG. 6 is an elevational view of a cross-like bullet connector.
Figure 9:
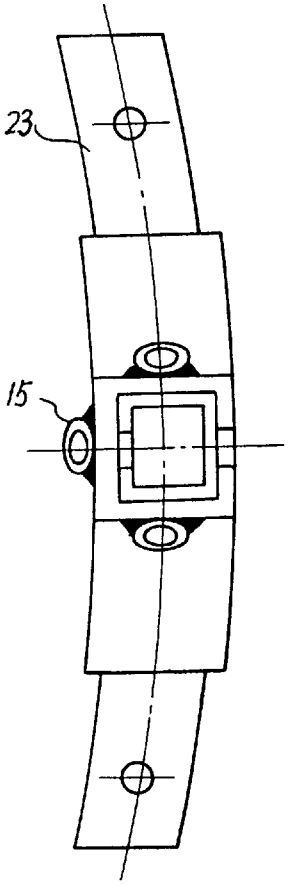
FIG. 9 is a side view of the T-shaped bullet connector.
Figure 8:
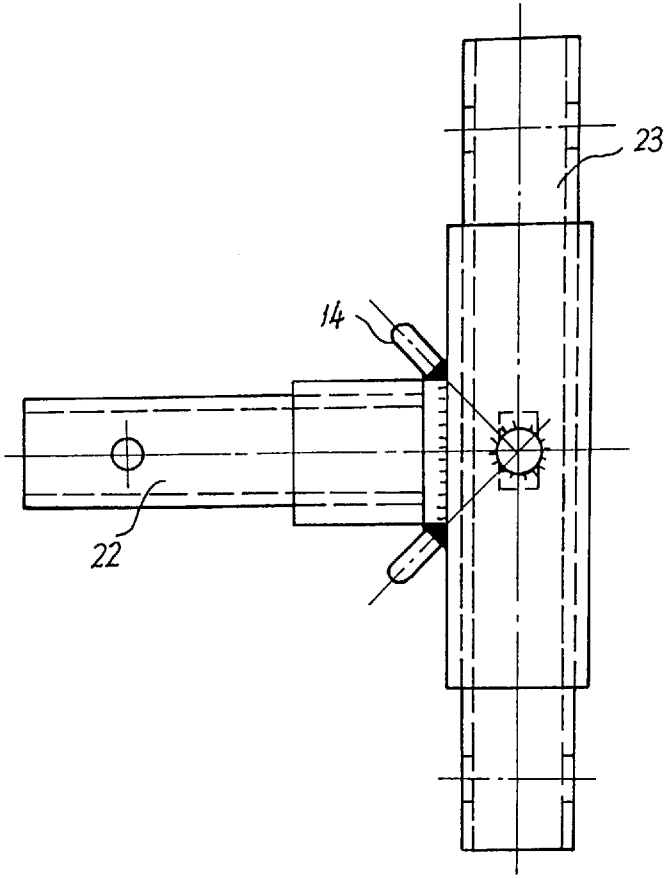
FIG. 8 is an elevational view of a T-shaped bullet connector.
Figure 11:
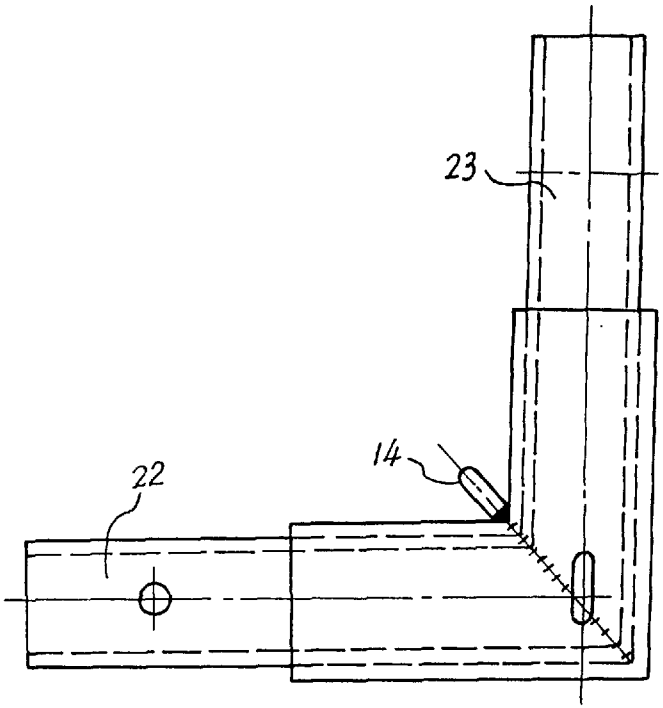
FIG. 11 is a side view of the right-angled bullet connector.
Figure 10:
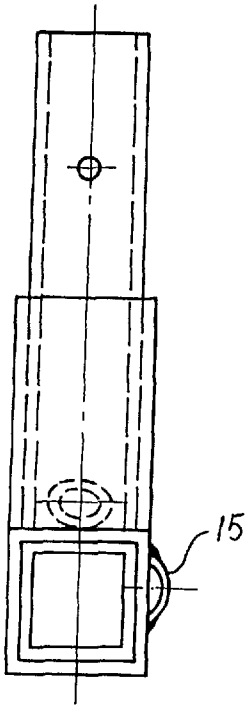
FIG. 10 is an elevational view of a right-angled bullet connector.
Figure 12:
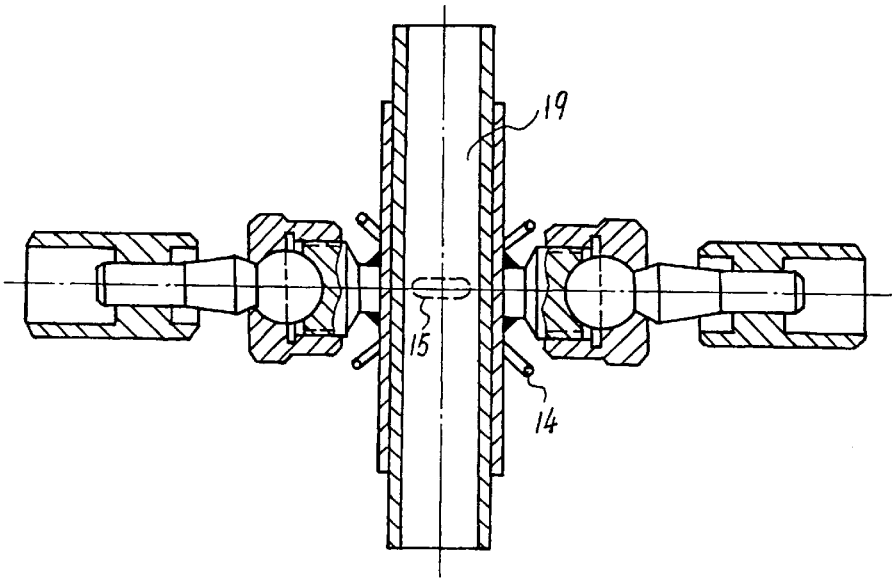
FIG. 12 is a configurational representation of a cross-like universal bullet connector.
Figure 13:
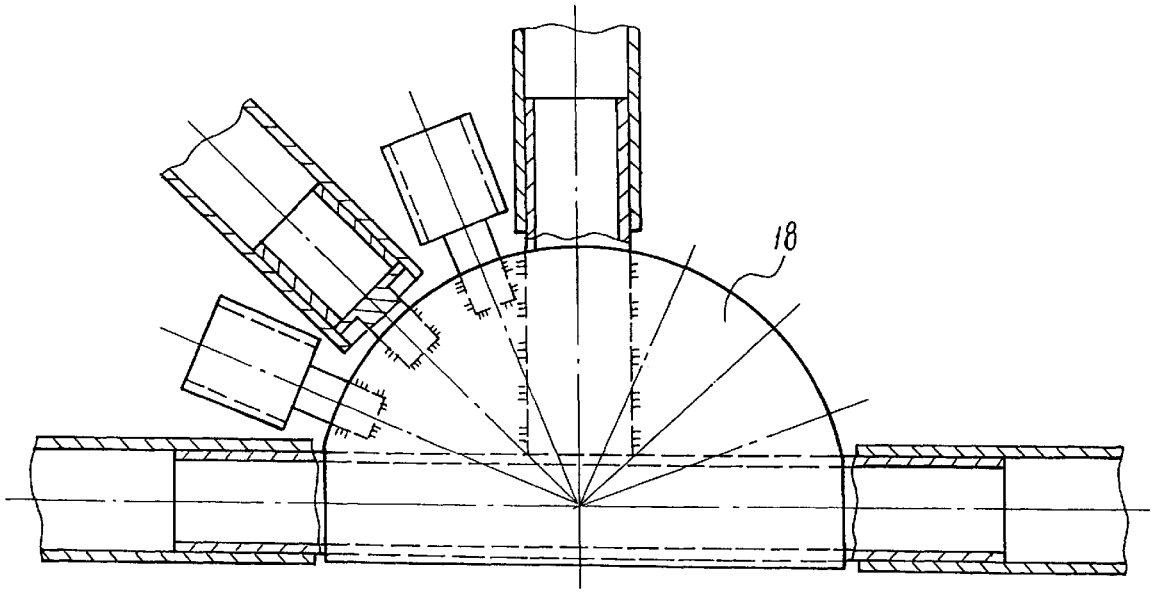
FIG. 13 is a schematic view of a semicircular multi-head bullet connector.
Figure 15:
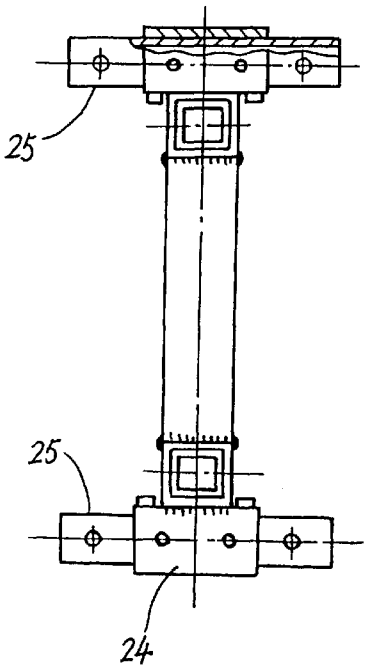
FIG. 15 is a side view of the rectangular-shaped bullet connector.
Figure 14:
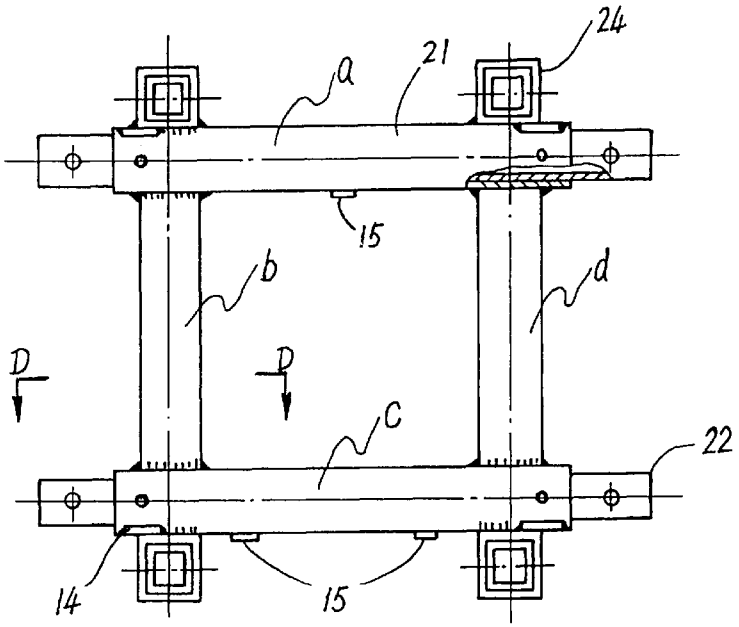
FIG. 14 is an elevational view of a rectangular-shaped bullet connector.
Figure 16:
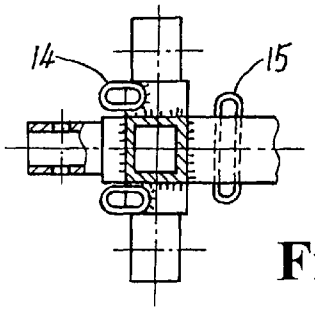
FIG. 16 is an sectional view of the rectangular-shaped bullet connector, taken along line D—D.
Figure 18:
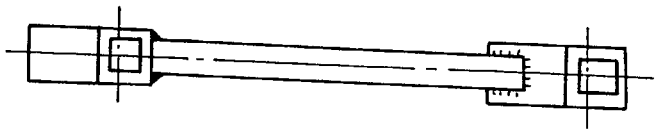
FIG. 18 is a side view of the double curved bar unit.
Figure 17:
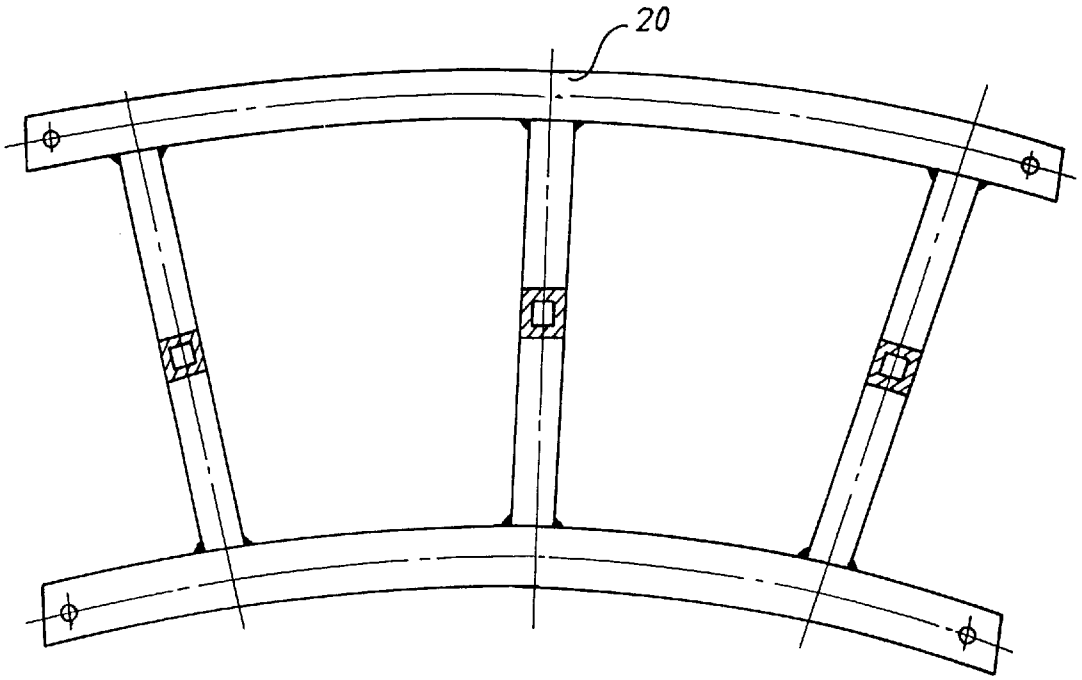
FIG. 17 is an elevational view of a double curved bar unit.
Figure 19:
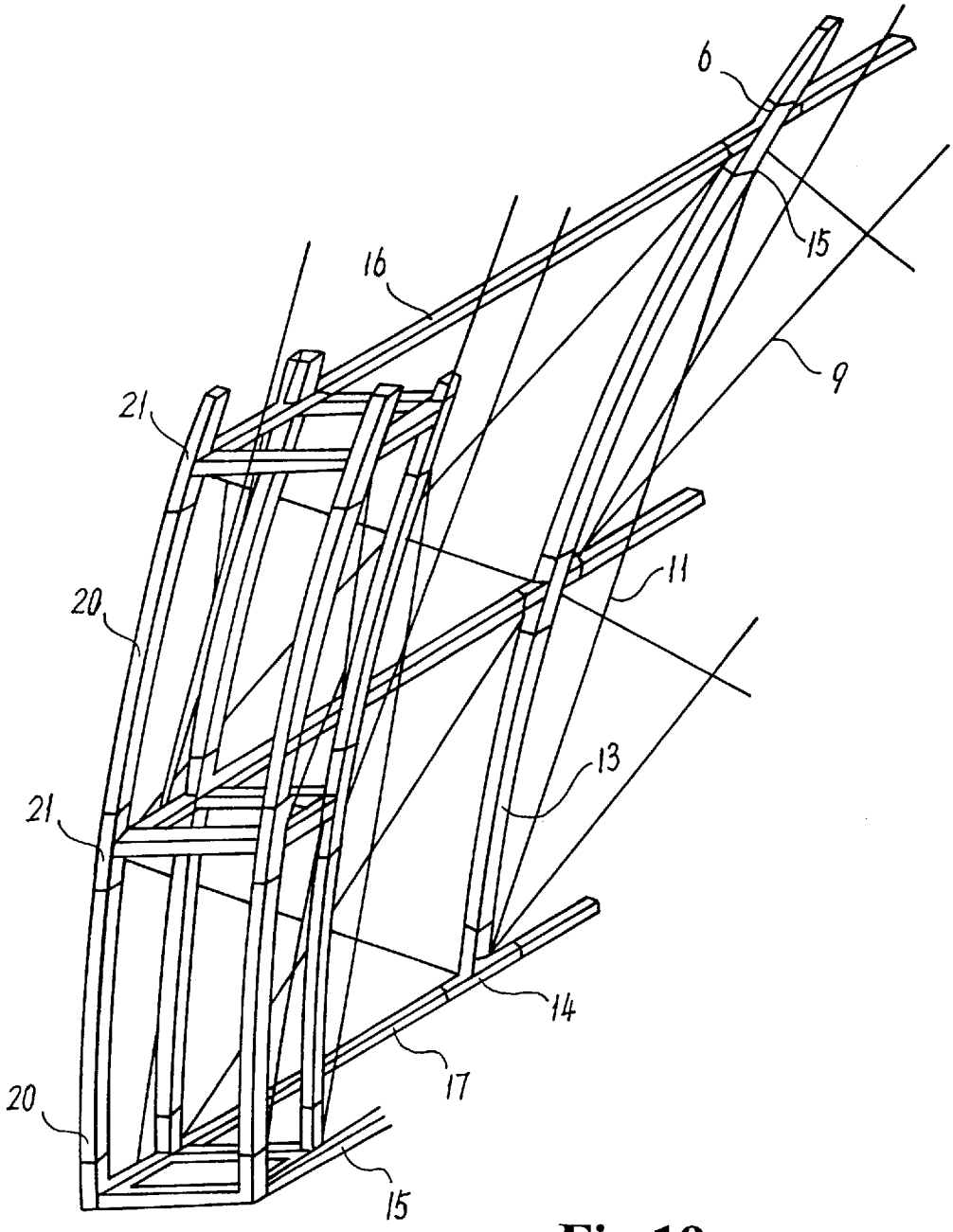
FIG. 19 is a partial perspective view of a single- and double-tier hybrid arched framework.

Now referring to the attached drawings, FIGS. 1 to 5 show an arched framework used for aircraft sheds and FIGS. 6 to 18 show all the components except straight bars, curved bars, tie rods and chord members. FIG. 19 shows a single- and double-tier hybrid arched framework.

An aircraft shed comprises two parts: A main body and end closures. The main body being completed and composed of a curved-surface single-and double-tier hybrid arched framework and an end closure through a spherical single-tier. There are two main bodies and two closures.

The framework of main body is formed by straight bars (16), curved bars (13), double curved bar units (20), cross-like bullet connectors (6), T-shaped bullet connectors (8), right-angled bullet connectors (7), rectangular-shaped bullet connectors (21), tie rods (9) and chord members (11).

At the ends of double curved bar units (20), straight bars (16) and curved bars (13) there are sockets. T-shaped bullet connectors (8), right-angled bullet connectors (7), cross-like bullet connectors (6) are all with straight bar spigots (22) and curved bar spigots (23). At each cut angle formed by the transverse intersection of a straight bar spigot (22) and a curved bar spigot (23) there is disposed a tie bar connecting lug (14). On each bullet connector there is only one chord member connecting lug (15). On a chord member connecting lug (15) there are locations for two chord members (11) to connect. The rectangular-shaped bullet connector (21) is formed by welding together four bars, a, b, c and d, each of square cross section to define a rectangle. At each end of bars a and c there is welded a straight bar spigot (22) coaxial with the bar. Two straight bar spigots (22) on the same bar are in opposite directions. On each outer side of bars a and c there are welded two connecting members (24) perpendicular to the rectangular plane of the rectangular-shaped bullet connector. Each connecting member (24) is formed by two oppositely directional curved bar spigots (25). All of the two connecting members (24) on the bars a and c of the rectangular-shaped bullet connectors (21) are equally spaced.

Chord member connecting lugs (15) are disposed on the same sides of bars a and c. On the outer side of bar a there is welded one chord member connecting lug (15), while on the inner side of bar c there are welded two chord member connecting lugs (15). On each of the connectors, the positions of chord member connecting lugs (15) are coincident. On each chord member connecting lug (15) there are locations for two chord members (11) to connect. In addition, at each cut angle formed by the transverse intersection of each straight bar spigot (22) and each curved bar spigot (25) on the rectangular-shaped bullet connector (21) there is disposed a tie rod connecting lug (14). At both ends of a tie rod (9) and a chord member (11) there are hooks to be in hooking engagements with tie rod connecting lugs (14) and chord member connecting lugs (15) of bullet connectors (6,7,8,21).

A double curved bar unit (20) is formed by welding together two curved bars with the same center but different bending radii and three connecting bars.

During construction, four double curved bar units (20) are transversely connected together through three rectangular-shaped bullet connectors (21) to form a curved column. Into the rectangular-shaped bullet connector (21) at each end of the curved column there is hookingly engaged one chord member (11) at the upper curved surface and there are two (11) at the lower, forming a double-tie bow-like frame. A single-tier bow-like frame is formed by connecting two curved bars (13) through a cross-like bullet connector (6) and insertingly engaging a cross-like bullet connector (6) to each unconnected end of the two curved bars, and then connecting a chord member (11) to the two cross-like bullet connectors (6) through chord member connecting lugs (15).

After a plurality of single-tier bow-like frames are disposed between two groups of double-tier bow-like frames, and all the single-and double-tier bow-like frames are longitudinally connected by straight bars (16) through straight bar spigots (22) on cross-like bullet connectors (6) and rectangular-shaped bullet connectors (21), the curved surface aircraft shed roof with double-tiers at two ends and single-tier in between is formed. By continuously insertingly engaging curved bars (13) or double curved bar units (20) in a transverse direction and straight bars (16) in a longitudinal direction on both laterals in transverse directions to the shed roof through cross-like bullet connectors (6) and rectangular-shaped bullet connectors (21), the main body of a curved-surface net-like aircraft shed is formed, having both single-and double-tier trusses and single-and double-tier arch-shaped frames.

The main body having a combination of quadrangular and hexagonal elements, will be gradually erected from the ground up to a high altitude while forming each quadrangular or hexagonal element. During the erection process, tie rods (9) and chord members (11) are continuously hookingly engaged onto each cross-like bullet connector or rectangular-shaped bullet connector (21). Tie rods (9) are crossedly disposed along diagonals of the quadrangle. Tie rods (9) connect trusses with trusses, trusses with arch-shaped frames and arch-shaped frames with arch-shaped frames. For either cross-like bullet connectors (21) located in single-tier arched frames or rectangular-shaped bullet connectors (21) located in the double-tier arch-shaped frames, except the lowest two tiers, into each tie rod connecting lug (15) there are hookingly engaged two chord members (11). All the chord members on single-and double-tier arch-shaped frames are crossedly hookingly engaged with each other to make the arched framework equally loaded, increasing its loading capacity.

By attaching two lateral bottoms of the main body through bullet connectors (6,21) with strengthening straight bars (17), the entire aircraft shed with an arched framework is formed.

There are two end closures disposed respectively at the openings of the main body. Each end closure is of a one-fourth sphere type, formed by curved bars (13), straight bars (16), cross-like universal bullet connectors (19), T-shaped bullet connectors, right-angled bullet connectors (7), tie rods (9), chord members (11) and semicircular multi-head bullet connectors (18). On a semicircular multi-head bullet connector (18) there are curved bar spigots (23) and some tie rod connecting lugs (14) and a chord member connecting lug (15). On a cross-like universal bullet connector there is a pair of ball-head swivelling spigots used for insertingly engaging straight bars. At the cut angles between the swivelling spigots and the curved bar spigots of a cross-like universal bullet connector (19) there are also disposed tie rod connecting lugs (14), and at the center of the connector (19) there is disposed a chord member connecting lug (15).

By insertingly engaging nine curved bars (13) to the curved bar spigots on semicircular multi-head bullet connector (18) and spacedly connecting the nine curved bars through cross-like universal bullet connectors (19) with straight bars (16), a semispheric shed roof is formed. Every time a curved bar (13) is employed, a straight bar (16) will be used to provide a space connection. With such operation continuously repeated, a one-forth sphere type of closure formed by nine single-tier arch-shaped frames and a plurality of quadrangular and triangular elements will be gradually erected to form the semicircular shed roof to the grounding end. While forming each quadrangular or triangular element, tie rods (9) and chord members (11) are hookingly engaged. Finally, by attaching strengthening straight bars (17) to the nine arc-shaped frames, an end closure is completed.

The aircraft shed made by the present arched framework is provided with doors (1), windows (2), an outer body (10), inner body (12) and lounge (4). The aircraft shed can be moved when moving wheels (5) are mounted on the strengthening straight bars (17). When moving out the end closures, both ends of the aircraft shed are opened, and aircrafts can get a free access to it; when the main framework and the closures are integrally connected with each other, through attachments (3), the aircraft shed can become closed. The aircraft shed can be assembled or dissembled as desired in accordance with the requirements.

Another embodiment of the present invention is a large-spanned tennis gym constructed by using a double-tier arched framework. The double-tier arched framework is formed by double curved bar units (20), rectangular-shaped bullet connectors (21), straight bars (16), strengthening straight bars (17), tie rods (9) and chord members (11). Firstly, a plurality of rectangular-shaped bullet connectors (21) are linearly connected by strengthening straight bars (17) through straight bar spigots (22) provide a lateral bottom of the tennis gym. After all the rectangular-shaped bullet connectors (21) in the lateral bottom are transversely insertingly engaged with double curved bar units (20), rectangular-shaped bullet connectors and straight bars (16) are further used to connect all of the double curved bar units (20) together.

Thus, a plurality of longitudinally connected hexagonal elements are formed at the lateral bottom of the tennis gym. While forming each hexagonal element, into each rectangular-shaped bullet connector (21) there are hookingly engaged tie rods (9) and chord members (11). Tie rods (11) are hookingly engaged along the diagonals of rectangular frames formed by straight bars (16) and double curved bar units (20). Chord members (11) are hookingly engaged and are formed by the connecting lines between the farthest ends of two transversely connected double curved bars (20). After sequentially connecting in above manner, length by length, double curved bar units (20), straight bars (16), rectangular-shaped bullet connectors (21), tie rods (9) and chord members (11), the main body of tennis gym of a double-tier arched framework, will be completed on the ground from the ground end on one side of the gym, to the roof of the gym, and to the grounding end on the other side of the gym.

The closures of the tennis gym are of elevational wall type. They can be completed only by sequential inserting end hooking engagements of straight bars (16), tie rods (9) and rectangular-shaped bullet connectors in transverse and vertical directions.

In the scheme description and the embodiments, the present invention has given out three assembling methods: constructing an arch-shaped frame at one end first, then extending it longitudinally; or constructing the shed roof of an arched framework first, then extending it to both sides; or constructing one lateral of the arched framework along its longitudinal length, then extending it to the other lateral.

Houses, highway bridges, flyovers, river bridges, exhibition halls and huge sheds, etc. are examples of the structures covered by the technique of the present invention. The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A single-tier arched framework comprising:

a plurality of curved bars, each curved bar having end sockets;

a plurality of straight bars, each straight bar having end sockets;

a plurality of tie rods;

a plurality of chord members; and a plurality of bullet connectors, each bullet connector having spigots and being insertingly engaged with the straight bars and the curved bars and hookingly engaged with the tie rods and chord members, wherein end sockets of curved bars, straight bars, and the spigots of bullet connectors are mutually insertingly engaged mating pairs;

the curved bars being insertingly engaged along a curve through the bullet connectors to form arc-shaped frames, the chord members being connected to the arc-shaped frames through the bullet connectors, the arc-shaped frames being substantially parallel to each other, the arc-shaped frames being longitudinally connected together through the bullet connectors by the straight bars, the straight bars being connected along substantially straight lines to compose trusses, said trusses being substantially parallel to each other and substantially orthogonally connected to each arc-shaped frame, the arc-shaped frames and trusses are connected by a plurality of tie rods to form an integral curved structure.

2. The single-tier arched framework as claimed in claim 1, wherein said integral curved structure is composed of a plurality of quadrangular elements, each quadrangular element includes four bullet connectors and two straight bars and two curved bars, the four bullet connectors provide four corners of each quadrangular element, the curved bars and straight bars are orthogonally insertingly engaged into the bullet connectors to form adjacent sides, along two diagonals of each quadrangular element is a tie rod, each end of the tie rod being hookingly engaged with a bullet connector, each chord is defined by ends of two farthest spaced curved bars, along each cord are a pair of quadrangular elements connected transversely, each end of a chord member is hookingly engaged with each bullet connector, said arc-shaped frames are composed of a plurality of bow-shaped frames, each two adjacent chord members in each arc-shaped frame are crossed relative to each other.

3. The single-tier arched framework as claimed in claim 1, wherein each bullet connector is at least one of right-angled bullet connectors, T-shaped bullet connectors and cross-shaped bullet connectors, straight bar spigots and curved bar spigots are provided on each of the bullet connectors, a tie rod connecting lug is disposed at each cut angle formed by the straight bar spigots and curved bar spigots, on each of the bullet connectors a chord member connecting lug is disposed, and each chord connecting lug includes locations for two chord members to be connected thereto.

4. The single-tier arched framework as claimed in claim 3, wherein an intersection of central lines of four quadrangular elements which are connected with each other is formed by a cross-shaped bullet connector, at edges of the integral structure, an intersection of two quadrangular elements is formed by a T-shaped bullet connector, at the four corners of the integral curved structure, a corner of one quadrangular element is formed by a right-angled bullet connector.

5. A single-tier arched framework, comprising:

a plurality of curved bars;

a plurality of straight bars;

a plurality of tie rods;

a plurality of chord members;

a plurality of T-shaped bullet connectors;

a plurality of cross-shaped universal bullet connectors; and a semicircular multi-head bullet connector, each bullet connector is insertingly engaged with the straight bars and the curved bars and hookingly engaged with the tie rods and the chord members, each semi-circular multi-head bullet connector is insertingly engaged with the curved bars, the curved bars are insertingly engaged along a curve through the cross-shaped universal bullet connectors to form arc-shaped frames, the chord members through hooking engagements with a predetermined number of bullet connectors connect to the arc-shaped frames, said arc-shaped frames are formed by insertingly engaging with the curved bars into a unit, upper ends of the arc-shaped frames converge on one semi-circular multi-head bullet connector, straight bars connect with the arc-shaped frames through the cross-shaped universal bullet connectors on the arc-shaped frames, straight bars are linearly connected with straight bars in a horizontal direction to form trusses, each truss being of a polygonal line shape, the tie rods join through a plurality of bullet connectors, the arc-shaped frames and trusses are joined by the tie rods to form an approximate integral quarter-spheric structure.

6. The single-tier arched framework as claimed in claim 5, wherein said integral structure is formed by a plurality of quadrangular and triangular elements which form lattices, a row of triangular elements are disposed between the semi-circular multi-head connector and an adjacent row of quadrangular elements, each triangular element includes one straight bar, two curved bars, two bullet connectors, two spigots of the semi-circular multi-head bullet connectors, two chord members and two tie rods, each quadrangular element includes four bullet connectors, two curved bars and two straight bars, the four bullet connectors of each quadrangular element form four corners of each quadrangular element, the curved bars and straight bars are orthogonally insertingly engaged into the bullet connectors to form adjacent sides, along two diagonals of each quadrangular element is a tie rod, and each end of the tie rod is hookingly engaged with a bullet connector.

7. The single-tier arched framework as claimed in claim 5, wherein said integral structure is formed by a plurality of quadrangular and a row of triangular elements which form lattices, said triangular row of elements are disposed between the semi-circular multi-head bullet connector and an adjacent row of quadrangular elements, each triangular element includes one straight bar, two curved bars, two bullet connectors, two spigots of the semi-circular multi-head bullet connector, two chord members and two tie rods, each quadrangular element includes four bullet connectors, two curved bars and two straight bars, the four bullet connectors of each quadrangular element form four corners of each quadrangular element, the curved bars and straight bars are orthogonally insertingly engaged into the bullet connectors to form adjacent sides, along two diagonals of a quadrangular element a tie rod is disposed, each end of a tie rod is hookingly engaged with a bullet connector, each chord is defined by the farthest spaced ends of two curved bars, along each cord is a pair of transversely adjacent quadrangular elements, each end of a chord is hookingly engaged with a bullet connector, two curved bars and one chord member form a bow-shaped frame, each arc-shaped frame is composed of the predetermined number of bow-shaped frames, each two adjacent chord members in each arc-shaped frame are crossed relative to each other.

8. The single-tier arched framework as claimed in claim 5, wherein the semi-circular multi-head bullet connector is composed of a semi-circular disk, curved bar spigots, chords, tie rod connecting lugs, and chord member connecting lugs, the curved bar spigots having the same downward bending angle are uniformly distributed along the curved perimeter of the semi-circular disk, a tie rod connecting lug is disposed at each cut angle formed by the curved bar spigots and the semi-circular disk, and under a bend axis of each curved bar spigot a chord member connecting lug is disposed.

9. The single-tier arched framework as claimed in claim 5, wherein each cross-shaped universal bullet connector includes two opposite curved bar spigots and two opposite ball-head swivelling spigots, at each cut angle formed by the intersection of the swivelling spigots and the curved bar spigots a tie rod connecting lug is disposed, a chord member connecting lug is disposed on each cross-shaped universal bullet connector, and two chord members connect to the chord member connecting lug.

10. A double-tier arched framework, comprising:

a plurality of straight bars;

a plurality of tie rods;

a plurality of chord members;

a plurality of double curved bar units; and a plurality of rectangular shaped bullet connectors; double curved bar units and straight bar units and tie rods and chord members are insertingly and hookingly engaged into each rectangular-shaped bullet connector, a double-ridge double-tier arc-shaped frame of rectangular cross section is formed through the inserting engagements of the double curved bar units with the rectangular-shaped bullet connectors, through the rectangular-shaped bullet connectors, the cord members connect the double-tier arc-shaped frames formed by insertingly engaging with double curved bar units into an integral unit, double-tier arc-shaped frames parallel to each other are longitudinally connected together through the rectangular-shaped bullet connectors and by a plurality of straight bars grouped two by two, the straight bars are linearly connected together in groups to form double-ply trusses, the double-ply trusses parallel to each other are orthogonally connected with a predetermined number of arc-shaped frames, the tie rods join the double-tier arc-shaped frame with the double-ply trusses through rectangular-shaped bullet connectors to form an integral curved structure.

11. The double-tier arched framework as claimed in claim 10, wherein said integral structure is formed by a plurality of hexagonal elements which form lattices, each hexagonal element includes four rectangular-shaped bullet connectors, four portions of double curved bar units and four straight bars, two-rectangular shaped bullet connectors are insertingly engaged with two portions of double curved bar units to form a length of a curved column having a rectangular cross-shaped section, two groups of straight bars, having two straight bars in each group, are orthogonally insertingly engaged into the rectangular-shaped bullet connectors of each end of two curved columns and together with two portions of double curved bar units form two rectangular frames having upper and lower curved surfaces parallel to each other, along two groups of diagonals of each rectangular frame tie rods are disposed, similar ends of the tie rods in two rectangular frames are hookingly engaged with the same rectangular-shaped bullet connector, at least one chord member is disposed in the direction of an extension of the double curved bar units of each two transversely adjacent hexagonal elements, similar ends of upper and lower chord members are each hookingly engaged with the same rectangular-shaped bullet connector, two curved columns are connected with upper and lower chord members to form double-tier bow-shaped frames, each double-tier arc-shaped frame is composed of the double-tier bow-shaped frames, each two adjacent chord members in an arc-shaped frame are crossed relative to each other in a double-tier arched framework, a central junction is formed by a rectangular-shaped bullet connector and portions of each of the four hexagonal elements respectively.

12. The double-tier arched framework as claimed in claim 10, wherein each rectangular-shaped bullet connector is composed of four bars forming a rectangular plane, at each end of two parallel bars in said rectangular-shaped bullet connector is a straight bar spigot coaxial with the bars, two straight bar spigots on a bar are in opposite directions, on each outer side of two parallel bars are two connecting members perpendicular to the rectangular plane, each connecting member is composed of two curved bar spigots in opposite directions, the double curved bar units and rectangular-shaped bullet connectors have two connecting members on each bar being equally spaced, at least one chord member connecting lug is on similar sides of two parallel bars, on each chord member connecting lug are locations for two chord members to connect, a chord member connecting lug is simultaneously hookingly engaged with two chord members in different directions, and a tie rod connecting lug is at each cut angle formed orthogonally by each straight bar spigot and each curved bar spigot.

13. The double-tier arched framework as claimed in claim 10, wherein each double curved bar unit is composed of two curved bars having a common center but different radii and a plurality of connecting bars, the double curved bar unit is planar, and two sockets are at each end.

14. The double-tier arched framework as claimed in claim 13, wherein the straight bars and double bars have sockets which are insertingly engaged with the spigots of the rectangular-shaped bullet connectors to become mutual mating pairs, and the distance between the centers of two sockets at an end of each double curved bar unit is equal to two connecting members of a rectangular-shaped bullet connector.

15. An assembling method without high-altitude operation for a single-tier arched framework, comprising the steps of:

insertingly engaging two curved bars into a cross-shaped bullet connector to form bow-shaped frames;

connecting longitudinally a plurality of straight bars to the bow-shaped frames;

forming two rows of shed roof portions having a plurality of quadrangular elements and with a longitudinal length of an arched framework;

lifting one lateral part of the shed roof by a jacking device to reach a level for curved bars to be insertingly engaged;

insertingly engaging curved bars into each bow-shaped frame through bullet connectors; insertingly connecting engaged curved bars through straight bars to form a longitudinal row of quadrangular elements;

while forming the quadrangular elements, hookingly engaging tie rods and chord members;

lowering one lateral part of said shed roof and lifting an opposing lateral part of said shed roof;

connecting curved bars, straight bars and cross-shaped bullet connectors to further form a row of quadrangular elements; and repeating the preceding steps at each lateral part of a shed roof end to two grounding ends of the arched framework.

16. An assembling method without high-altitude operation for a single-tier arched framework, comprising the steps of:

connecting a plurality of strengthening straight bars into a lateral grounding end along a longitudinal length of the arched framework by using two right-angled bullet connectors and a plurality of T-shaped bullet connectors;

insertingly engaging curved bars into the bullet connectors;

connecting a plurality of straight bars to curved bars through a plurality of cross-shaped bullet connectors, forming a row of connected quadrangular elements with a longitudinal length of the arched framework;

while forming the quadrangular elements, hookingly engaging tie rods and chord members;

lifting a straight bar lateral of the quadrangular elements by a jacking device to reach a level for curved bars to be insertingly engaged;

forming another row of quadrangular elements by insertingly engaging curved bars and longitudinally connecting the curved bars by a plurality of straight bars through cross-shaped bullet connectors;

lifting the quadrangular elements by a jacking device to reach a level for curved bars to be insertingly engaged;

forming a row of quadrangular elements through the inserting engagements of cross-shaped bullet connectors with curved bars;

repeating the preceding steps to sequentially expand the quadrangular elements transversely to gradually erect a main body of a single-tier arched framework from one lateral ground end of the arched framework to the other lateral ground end.

17. An assembling method without high-altitude operation for a double-tier arched framework, comprising the steps of:

forming a double-tier bow-shaped frame through four double curved bar units connected together by three rectangular-shaped bullet connectors;

connecting longitudinally a plurality of double-tier bow-shaped frame by straight bars;

forming two rows of shed roof portions having a longitudinal length of the arched framework formed by a plurality of hexagonal elements;

lifting one lateral part of the shed roof by a jacking device, to reach a level for double curved bars to be insertingly engaged;

insertingly engaging curved bars through rectangular-shaped bullet connectors into each double-tier bow-shaped frame; insertingly engaging rectangular-shaped bullet connectors into other ends of the curved bars;

connecting the rectangular-shaped bullet connectors by a plurality of straight bars wherein a row of hexagonal elements is formed longitudinally;

while forming the hexagonal elements, hookingly engaging tie rods and chord members;

lowering one lateral part of the shed roof and lifting an opposing lateral part of the shed roof;

connecting double curved bar units, straight bars and rectangular-shaped bullet connectors to further form another row of hexagonal elements; and repeating the preceding steps at each lateral part of the shed roof to gradually erect a main body of a double-tier arched framework from a shed roof end to grounding ends of the double-tier arched framework.

18. An assembling method without high altitude operation for a double-tier arched framework, comprising the steps of:

connecting a predetermined number of rectangular-shaped bullet connectors to a plurality of strengthening straight bars along a lateral grounding end of the arched frame work;

connecting the curved bars by using a plurality of straight bars having two bars in each group through the rectangular-shaped bullet connectors to form a row of hexagonal elements along a longitudinal length;

while forming the hexagonal elements, hookingly engaging tie rods and chord members;

lifting an edge corresponding to straight bars in the hexagonal element by a jacking device to reach a level for double curved bar units to be insertingly engaged;

insertingly engaging double curved bar units and connecting longitudinally the double curved bar units by a plurality of groups of the straight bars through rectangular-shaped bullet connectors to form another row of hexagonal elements;

lifting the hexagonal elements by a jacking device to reach a level for the double curved bar units to be insertingly engaged;

engaging rectangular-shaped bullet connectors with the double curved bar units; and repeating the preceding steps to expand sequentially hexagonal elements transversely to gradually erect a main body of a double-tier arched framework from one lateral grounding end of the arched framework to the other lateral grounding end.

* * * * *